US009316042B2

(12) United States Patent
Goldenberg

(10) Patent No.: US 9,316,042 B2
(45) Date of Patent: Apr. 19, 2016

(54) LOAD BEARING STRUCTURAL CLOSURE SYSTEM

(71) Applicant: 420820 Ontario Limited, Woodbridge (CA)

(72) Inventor: Shaul Goldenberg, Woodbrdige (CA)

(73) Assignee: ONTARIO LIMITED, Woodbridge, Ontario (CA)

( * ) Notice: Subject to any disclaimer, the term of this patent is extended or adjusted under 35 U.S.C. 154(b) by 0 days.

(21) Appl. No.: 13/761,934

(22) Filed: Feb. 7, 2013

(65) Prior Publication Data

US 2013/0212947 A1 Aug. 22, 2013

Related U.S. Application Data

(60) Provisional application No. 61/596,323, filed on Feb. 8, 2012.

(51) Int. Cl.

| | |
|---|---|
| ***E06B 3/50*** | (2006.01) |
| ***E06B 9/00*** | (2006.01) |
| ***E05D 15/26*** | (2006.01) |
| ***E06B 3/92*** | (2006.01) |

(52) U.S. Cl.

CPC ..... *E06B 3/5054* (2013.01); *E05D 15/26* (2013.01); *E06B 3/924* (2013.01); *E06B 9/00* (2013.01); *E06B 3/509* (2013.01)

(58) Field of Classification Search

CPC ..... E05D 15/26; E06B 3/5054; E06B 3/924; E06B 3/5063; E06B 3/5072; E06B 3/5081

USPC ..... 49/127–130, 176, 177, 178, 181, 156, 49/158, 160, 458, 182

See application file for complete search history.

(56) References Cited

U.S. PATENT DOCUMENTS

| | | | | | |
|---|---|---|---|---|---|
| 1,621,851 | A * | 3/1927 | Minich | 49/129 |
| 2,976,582 | A * | 3/1961 | Rosenthal | 49/127 |
| 3,334,375 | A * | 8/1967 | Hubbard | 16/97 |
| 3,654,732 | A * | 4/1972 | Schacht | 49/127 |
| 3,810,330 | A * | 5/1974 | Daggy | 49/127 |
| 5,682,710 | A * | 11/1997 | Davies et al. | 49/162 |
| 5,687,506 | A * | 11/1997 | Davies et al. | 49/260 |
| 5,749,172 | A * | 5/1998 | Isopahkala | 49/127 |
| 6,276,092 | B1 * | 8/2001 | Neo | 49/183 |
| 6,691,462 | B2 * | 2/2004 | Oestermann | 49/213 |
| 7,451,802 | B2 * | 11/2008 | Cianciolo et al. | 160/211 |
| 2012/0159851 | A1 * | 6/2012 | Seymour et al. | 49/177 |
| 2013/0139443 | A1 * | 6/2013 | Smith et al. | 49/181 |

* cited by examiner

*Primary Examiner* — Katherine Mitchell
*Assistant Examiner* — Marcus Menezes
(74) *Attorney, Agent, or Firm* — Greer Burns & Crain Ltd.

(57) ABSTRACT

A closure assembly comprising at least two closures moveable in a closure frame, said closure frame including a header, sill and including a track sized to extend the full-length the header and sill thereby providing for guided movement of each individual closure to the maximum extent to and from a fully closed position, the at least two closures presenting a straight line, in-line, closure, such as a window, entry door, French door, patio door assembly and when the closures are pivoted from a closed position whereat said closures are parallel to the extension of said closure frame to a second position wherein free end of the closer is pivoted away from the closure frame, the free end of said closure including an inter-engaging member which inter-engage with adjacent members to brace together said closures thereby against any loading such as wind loads or the like.

18 Claims, 21 Drawing Sheets

LOAD BEARING STRUCTURAL CLOSURE SYSTEM

FIELD OF THE INVENTION

This invention relates to multi-closure assemblies and particularly to those which may be used for windows, doors, patio doors, French doors, and entry doors or the like and finds particular application in patio doors, casement windows and specifically in a frame including multi-closure members such as individually pivoting casement style members which engage when fully closed, namely all closure members are closed, and provide a continuous shared plane, and when in the fully pivoted open position provide maximum opening from jamb to jamb for entry and exit from the dwelling.

BACKGROUND OF THE INVENTION

Generally in the window and door industry windows are considered to provide the main function of letting in light to a building. Of late it is desirable to have large windows within the building which improve the room lighting but which do not support structural loads. It is therefore a primary object of the invention to provide a preferably load bearing structural closure for installation within a building which includes a multiplicity of closures (and preferably casement style) to provide an enhanced shared plane assembly. Further and other objects of the invention will become apparent to one skilled in the art by considering the following summary of the invention and the more detailed description of the preferred embodiments illustrated herein.

SUMMARY OF THE INVENTION

According to one aspect of the invention there is provided a closure assembly comprising at least two closures moveable in a closure frame, said closure frame including a header, sill and including a track sized to extend the full-length of the header and sill from jamb to jamb thereby providing for guided movement of each individual closure to the maximum extent to and from a fully closed position, the at least two closures presenting a straight line or shared plane, in-line, closure, such as a window, entry door, French door, or patio door assembly and when the closures are pivoted from a closed position whereat said closures are parallel to the extension of said closure frame to a second position wherein the free end of the closure is pivoted away from the closure frame, the free end of said closures have an inter-engaging member which inter-engages with adjacent members to brace together said closures thereby against any loading such as wind loads or the like.

This invention takes advantage of prior known inventions also invented by the present inventor including the teachings of U.S. Pat. No. 5,687,506 and specifically FIGS. 1B, 2, and 3 there in. The teachings in relation to the construction of the pivoting shaft, pivot shoes, the rack, pinion and pivot shoe and the inter-engagement thereof are hereby incorporated by reference in their entirety as if they were written into this application. Further the teachings of U.S. Pat. No. 6,405,781 are also hereby incorporated by reference with respect to the teachings of screens contained within a pocket in the jamb of a closure assembly and the pocket being disposed in a jamb section and of a particular shape compatible with the shape of the pivot bracket as best seen in FIG. 48 of that patent.

Specifically referring to the closure assembly construction in the preferred embodiments, each consists of a frame including a header, sill, and two jambs, each header and sill including racks within each track and sized to fit the full-length of the header and sill in parallel fashion as per the teachings of the herein mentioned patents. The sashes in these frames are built on the same concept. Each casement as illustrated in the figures can include a bubble seal all around for exceptional waterproofing and weatherproofing. The shaft is provided on one side at the pivoting end of the closure and includes an engaging pivot shoe that rides in the track which includes a pinion gear that engages the rack in each track of the header and sill. The opposite side of the closure, namely the free end, is designed with an inter-engaging extrusion that works as an interlocking portion to secure each closure to one another whether in the closed position or the fully pivoted position. As a result no visible hardware is seen on the outside except for a casement handle on the first sash on the inside. The multiple shafts at the pivoting ends of the closures also serve to reinforce and strengthen the entire window by co-operating in an interlocking manner with the inter-engaging members at the free ends of the closures.

According to yet another aspect of the invention there is provided a closure assembly including multiple closures for example casement French doors, patio doors or the like which provide an improved appearance and clean straight line or in line appearance in a parallel closure assembly because of the unique pivoting and interlocking edge.

According to yet another aspect of the invention there is provided a closure assembly having two ends comprising first and second tracks disposed within the full length of a header and sill portion of said closure assembly proximate the top and bottom of the assembly respectively and extending from jamb to jamb of said assembly, at least three slidable and pivotable closure members for movement in relation to said tracks, the closure members including framing sections therefor and being engaged with the tracks proximate first and second pivots adjacent the pivoting end of each closure member, the first and second pivots being interconnected by a multiple segment shaft disposed within framing sections of said closure members, the shaft including at least two portions, the shaft providing for accurate installation, retention, removal, adjustment and alignment of the first and second pivots within the tracks in a substantially parallel line with respect to one another and for pivotally supporting the closure members which may be safely and securely pivoted away from the closure assembly, whereby the first and second interconnected pivots are adapted to remain engaged with the tracks while supporting the closure member both when it is pivoted away from the closure assembly and when it is slidable relative to the tracks, the closure members having a free end and a pivoting end with inter-engaging members proximate the free end of each closure member, which engage the adjacent closure member proximate the free end thereof when said closure members are pivoted to a fully open position and further positioned whereat the pivoting ends of said closure members are also located adjacent one another to provide a maximum opening to exit or enter a building at this position for example when said closure assembly is for a patio door, and wherein when said closures are at a fully closed position when adjacent pivot ends and free ends inter-engage and seal with respect to one another to present a shared plane, straight line in line flush appearance for all closures in relation to said closure assembly.

According to another aspect of the invention there is provided a closure assembly comprising:

1) an opening extending within a closure frame
   ii) the frame having two ends and having disposed therein or attached thereto track portions extending substantially parallel to said frame;

iii) at least three closure members having framing portions and two ends and being slidable within said track portions and pivotable proximate at least one end thereof and latchable in the track portions proximate the free end thereof;

iv) each of said track portions having disposed therein at least one pivot shoe adjacent the pivoting end of each closure member, each shoe being substantially compatibly shaped with the track portions and having a top and bottom, each shoe having disposed therein adjacent the pivoting end of the at least three closure members an opening extending from the top toward the bottom of the shoe wherein pivot means are disposed, said pivot means provided with said pivot shoe being interconnected by a multiple segment shaft disposed within said framing portions of said at least three closure members, the shaft including at least two portions, the shaft providing for accurate installation, retention, removal, adjustment and alignment of the first and second pivots within the track portions in a substantially parallel line for pivotally supporting the at least three closure members for safe and secure pivoting away from the closure assembly;

v) two closure members having latching means provided therewith for latching the two closure members in relation to the track portions to prevent the two closure members from pivoting upon the pivot means when each closure member remains slidable with said track portions;

vi) the at least three closure members being braced by the multiple segment shaft interconnecting the pivot means disposed with each of the track portions, the substantially parallel alignment of the pivot means provided by the multiple segment shaft preventing the pivot means from misaligning or disengaging from the relevant track portions when each closure member is rotated to an open position or when it remains slidable within said track, (vii) the closure members having a free end and a pivoting end with inter-engaging members proximate the free end of each closure member, which engage the adjacent closure member proximate the free end thereof when said closure members are pivoted to a fully open position and further positioned whereat the pivoting ends of said closure members are also located adjacent one another to provide a maximum opening to exit or enter a building at this position for example when said closure assembly is for a patio door, and wherein when said closures are at a fully closed position when adjacent pivot ends and free ends inter-engage and seal with respect to one another to present a shared plane, straight line in line flush appearance for all closures in relation to said closure assembly.

Preferably the first and second pivot portions further comprise a rotatable pinion disposed therewith for facilitating the movement of the carrier relative to the track.

Preferably the rotatable pinion moves in cooperation with a rack disposed with said track.

More preferably retractable screens are provided disposed within each jamb of the assembly which accumulates on and pays out (feeds out or rolls out) from a spring biased roll disposed within each jamb, the screen being retractable for egress or cleaning purposes, and available as desired by providing a detent on the opposite screen handle or closure frame engageable with the screen when in its operable position.

In a preferred embodiment a pivot shoe is provided for engagement with said rack and track further comprising a carrier having a top and a bottom, the carrier having disposed proximate the bottom thereof means, and preferably slots, for retaining rollers, and the rollers in use thereof for providing the smooth movement of the carrier within the track, preferably the rollers being engaged with a predetermined channel formed in said track, said carrier also having an opening disposed proximate the top thereof wherein a pivot gear is disposed.

DETAILED DESCRIPTION OF THE INVENTION

Figure 1:
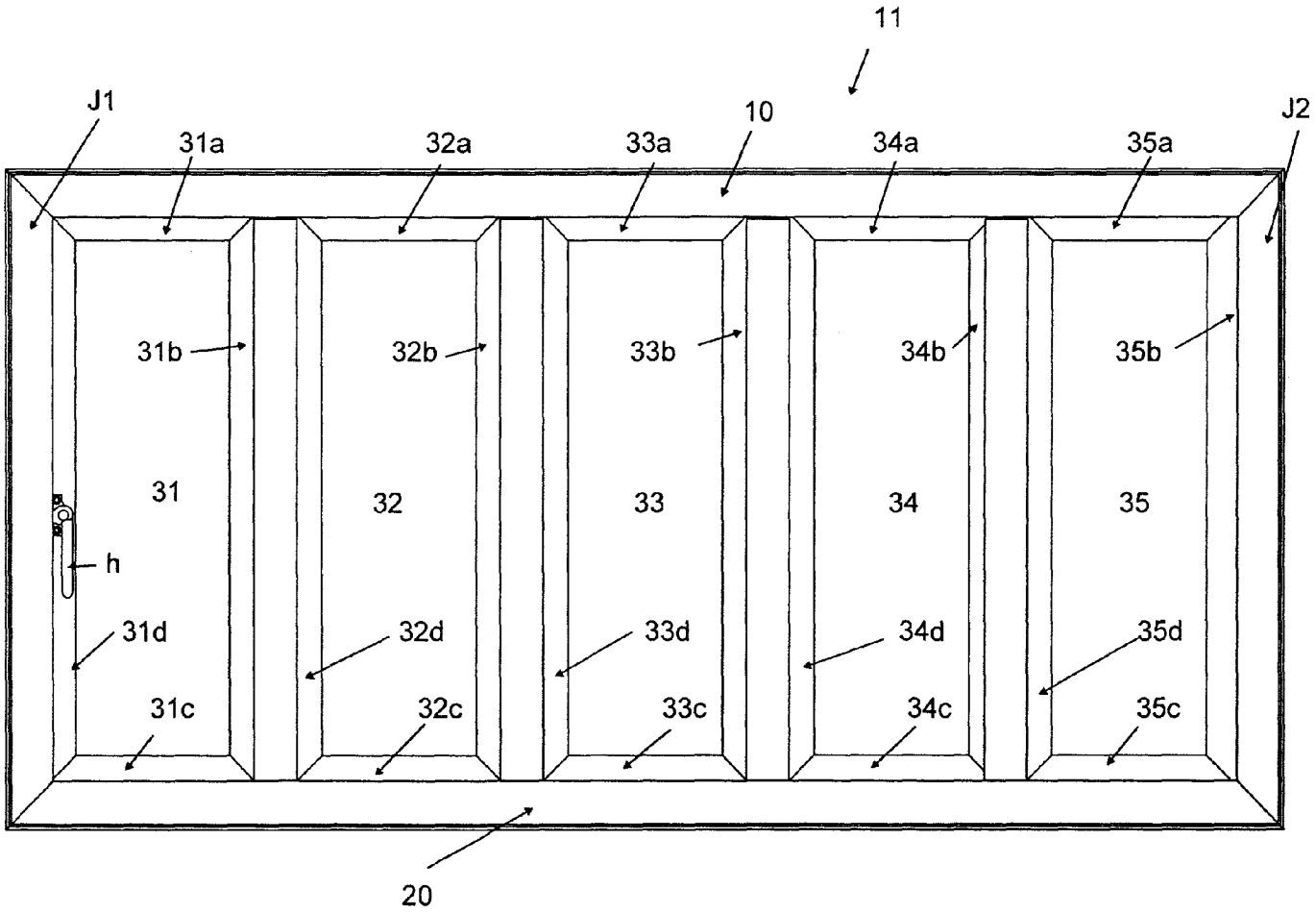
FIG. 1 is a front interior view of a frame assembly wherein multiple closures move in a horizontal direction, and pivot outwardly from said frame illustrated in a preferred embodiment of the invention.
Figure 6:
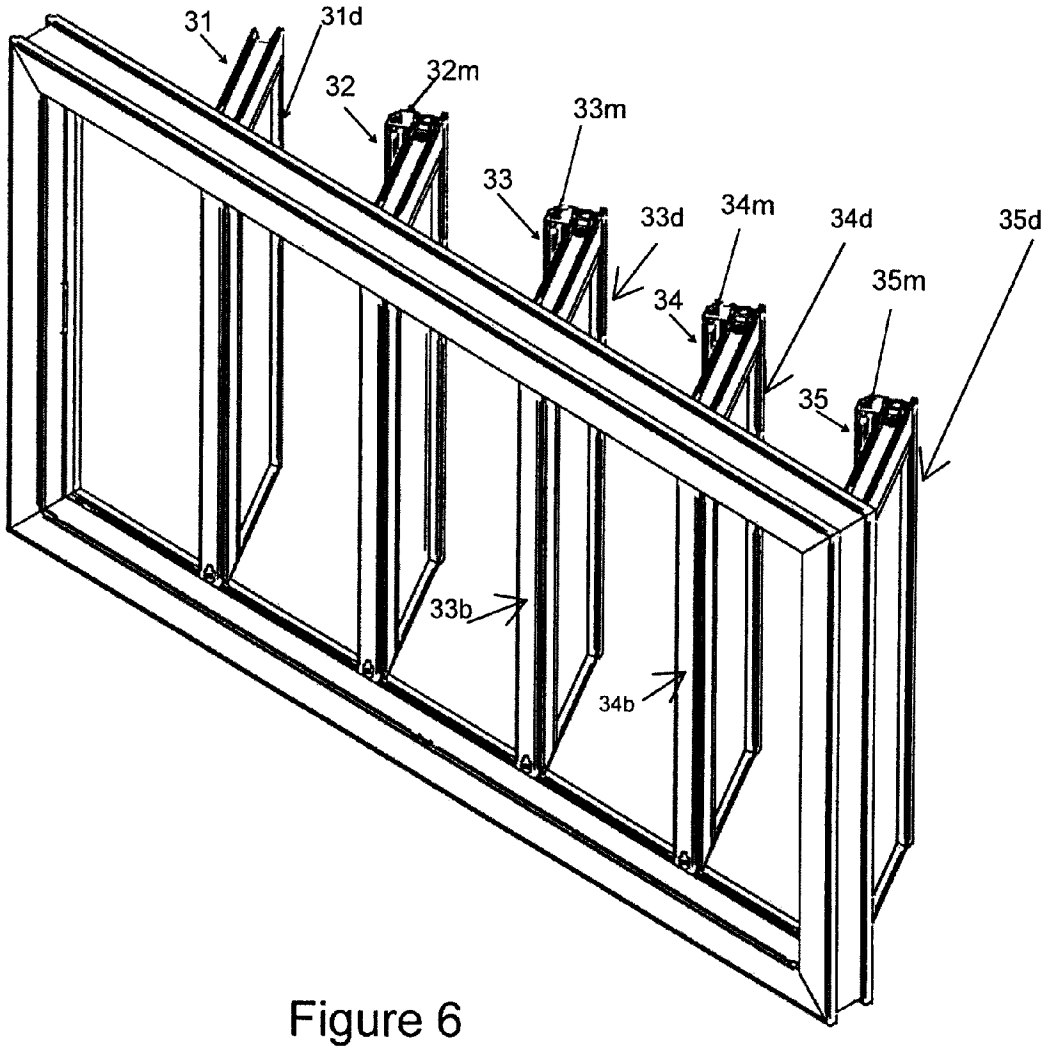
FIG. 6 is a further perspective view of FIG. 1 with all closures at the pivoted position illustrated in a preferred embodiment of the invention.

FIG. 1 is a front schematic view of the present invention illustrating five adjacent casement style closure members such as doors or window sashes 31-35 which are interconnected when at the closed position as shown. A special inter-engagement member (32*m*-35*m*) is disposed adjacent the free end (32*d*-35*d*) of each closure as best seen in FIG. 6 and provided for each closure with the exception of the closure member 31 at 31*d*.

A closure framing section 11 (FIG. 1) therefore is provided including a header 10 and a sill 20 with opposite jambs sections J1 and J2. The header section 10 may be reinforced or alternatively there may be contained within said frame above said header as necessary a lintel or the like to increase the load carrying ability of this assembly 11. A pivot shaft (T) (FIG. 13) is disposed at the pivoting end (31*b*-35*b*) of each closure member 31 through 35. Each closure member includes framing sections (31*a*-35*a* and 31*c*-35*c*) as well. A handle h is disposed on the left side of the closure member 31.

Figure 2:
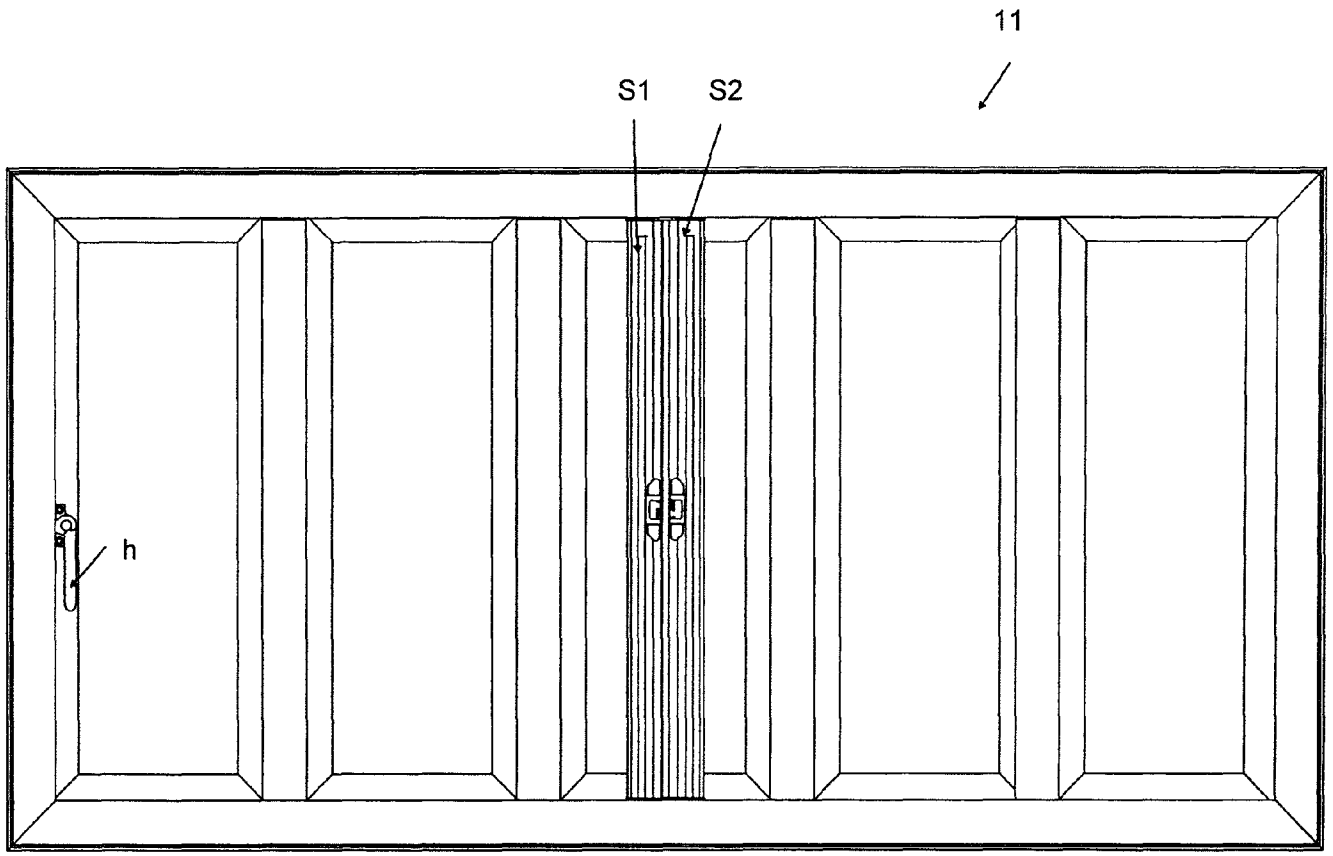
FIG. 2 is a front view of the frame assembly of FIG. 1 embodying the invention and depicting the use of rollout screens and illustrated in a preferred embodiment of the invention.
Figure 9A:
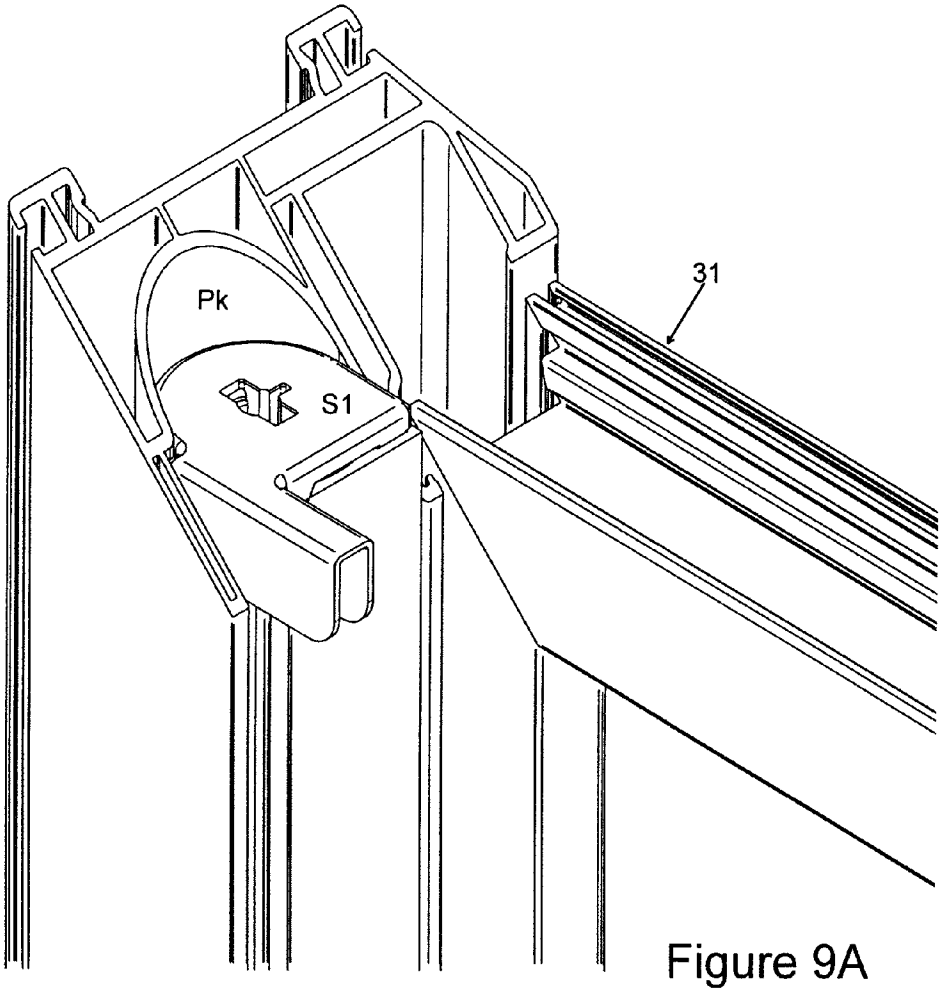
FIG. 9A is a close-up view of the assembly adjacent the top of closure 31 showing the preferred rollout screen assembly.

Referring now to FIG. 2 there is shown the invention of FIG. 1 further enhanced by a roll screen system S1, S2 which will be described hereinafter and is best seen in detail in a FIG. 9A. U.S. Pat. No. 6,405,781 also assigned to the present assignee provides the essential teachings of such a roll screen assembly which is incorporated by reference in relation the provision of a pocket in a jamb section of the closure frame and the compatible shape of a pivot bracket with said pocket.

Figure 3:
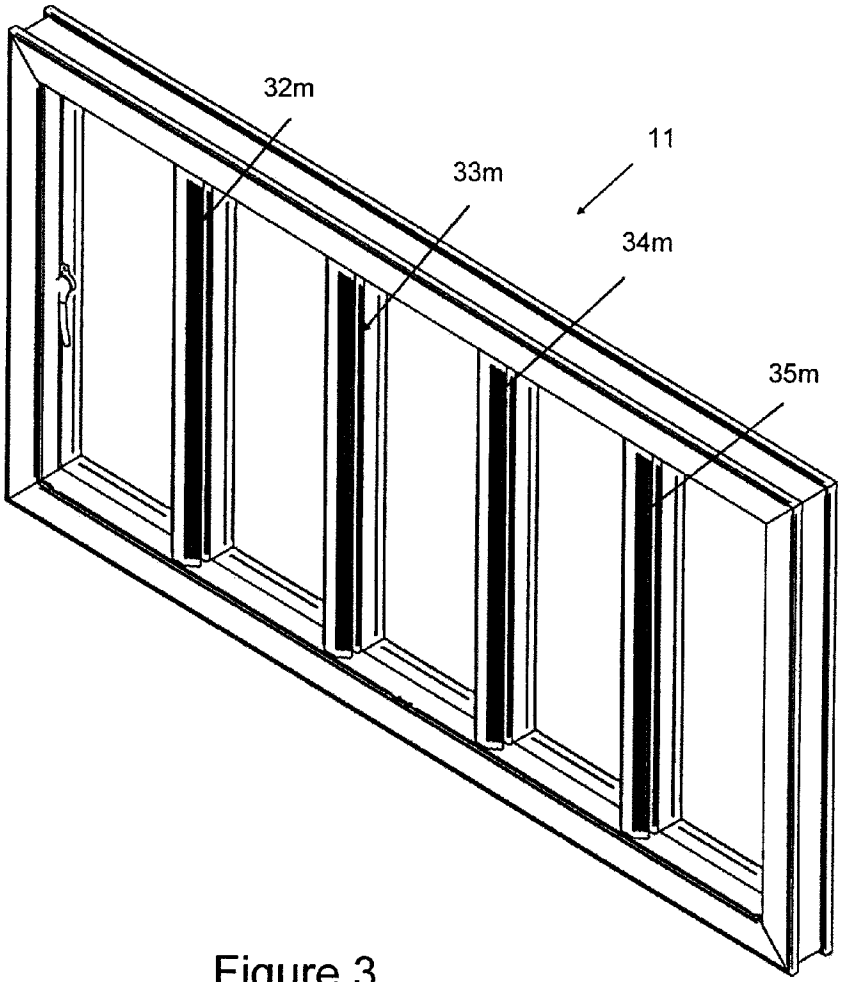
FIG. 3 is a perspective view of the frame assembly of FIG. 1 depicting the inter-engagement members in a preferred embodiment of the invention.

Referring to FIG. 3 the closure assembly is illustrated showing the inter-engaging members 32*m*-35*m* when in the closed position. These members also inter-engage at the fully open pivoted position to brace the assembly against any loading including wind loads. Please refer to FIGS. 8A and 8C in this regard.

Figure 4:
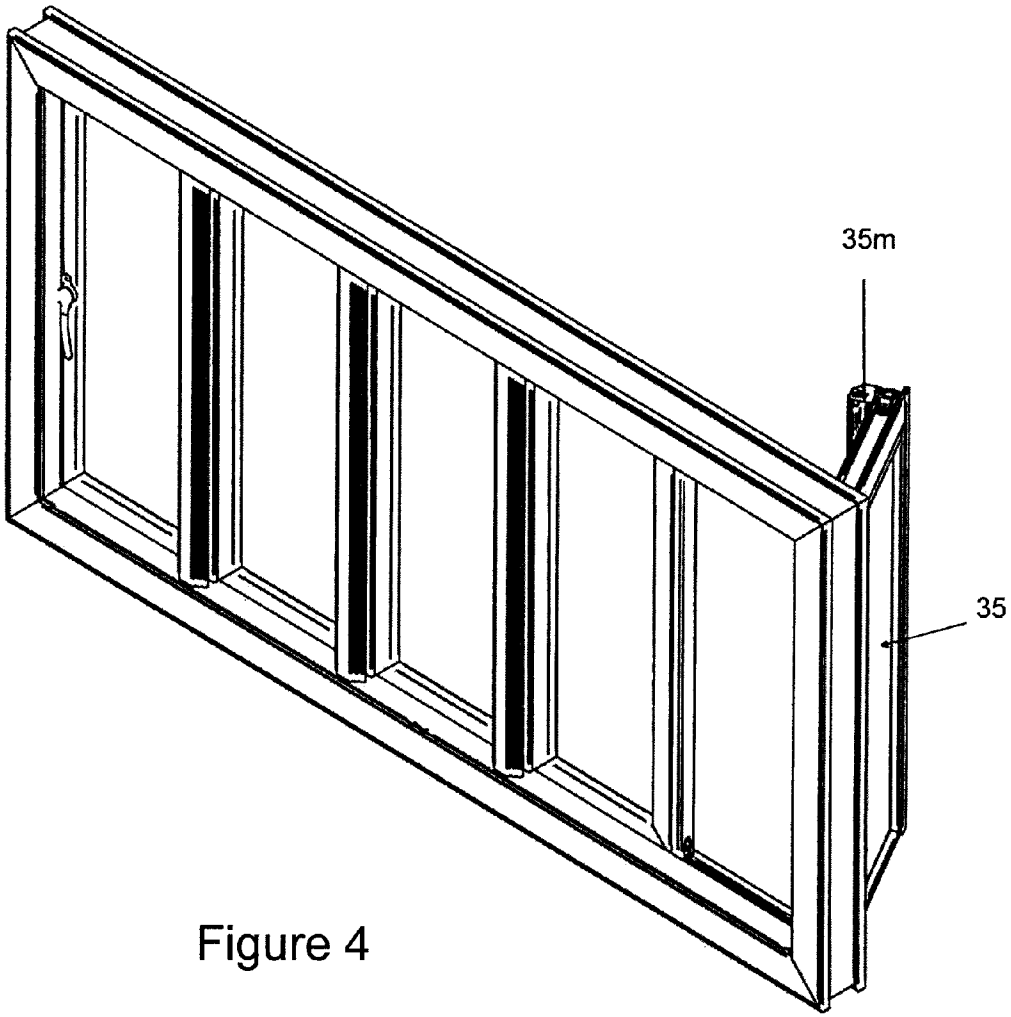
FIG. 4 is a similar view of the frame assembly of FIG. 3 depicting closure 35 thereof in an open position and illustrated in a preferred embodiment of the invention.
Figure 12:
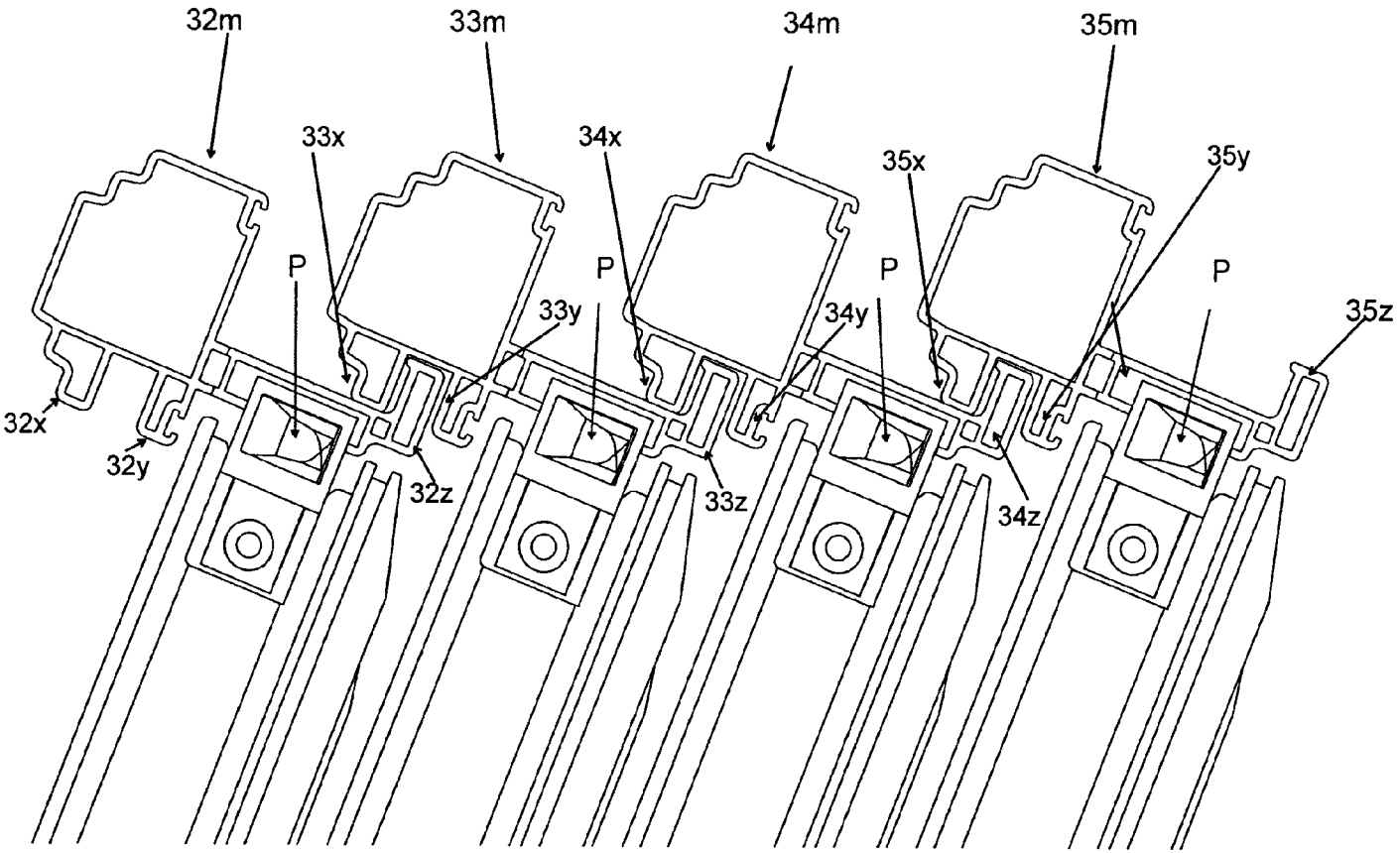
FIG. 12 is a similar view to FIG. 11 illustrated in a preferred embodiment of the invention.
Figure 14:
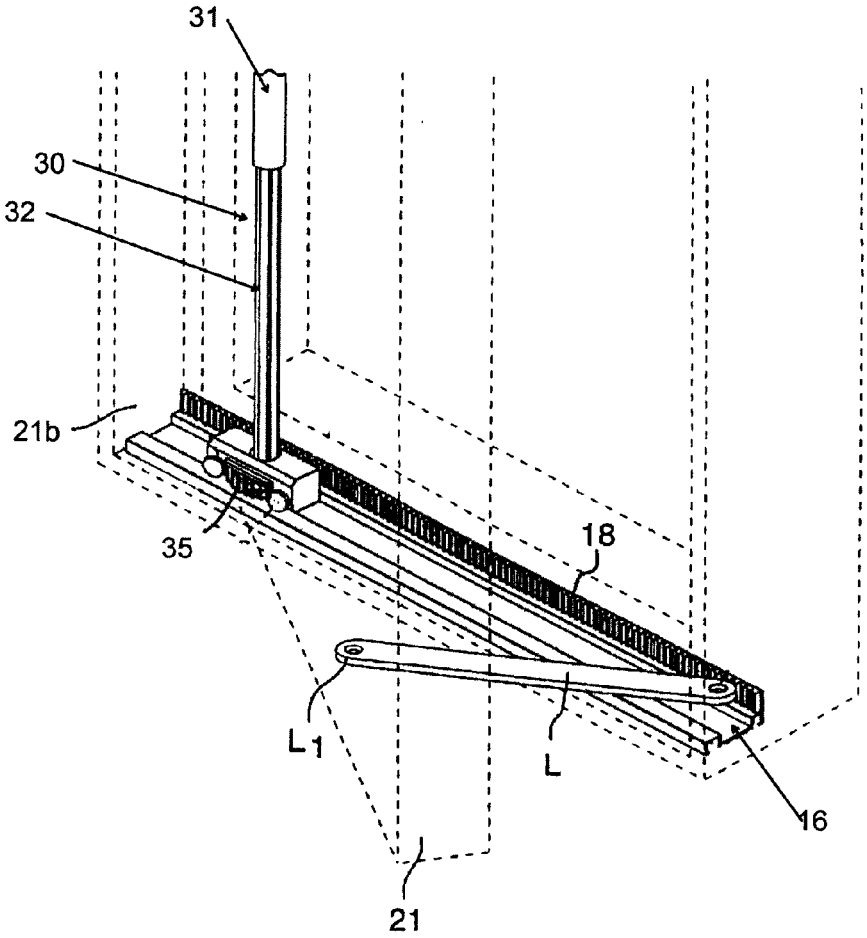
Figure 14 (PRIOR ART)
FIGS. 14, 15 and 16 are prior art.
Figure 15:
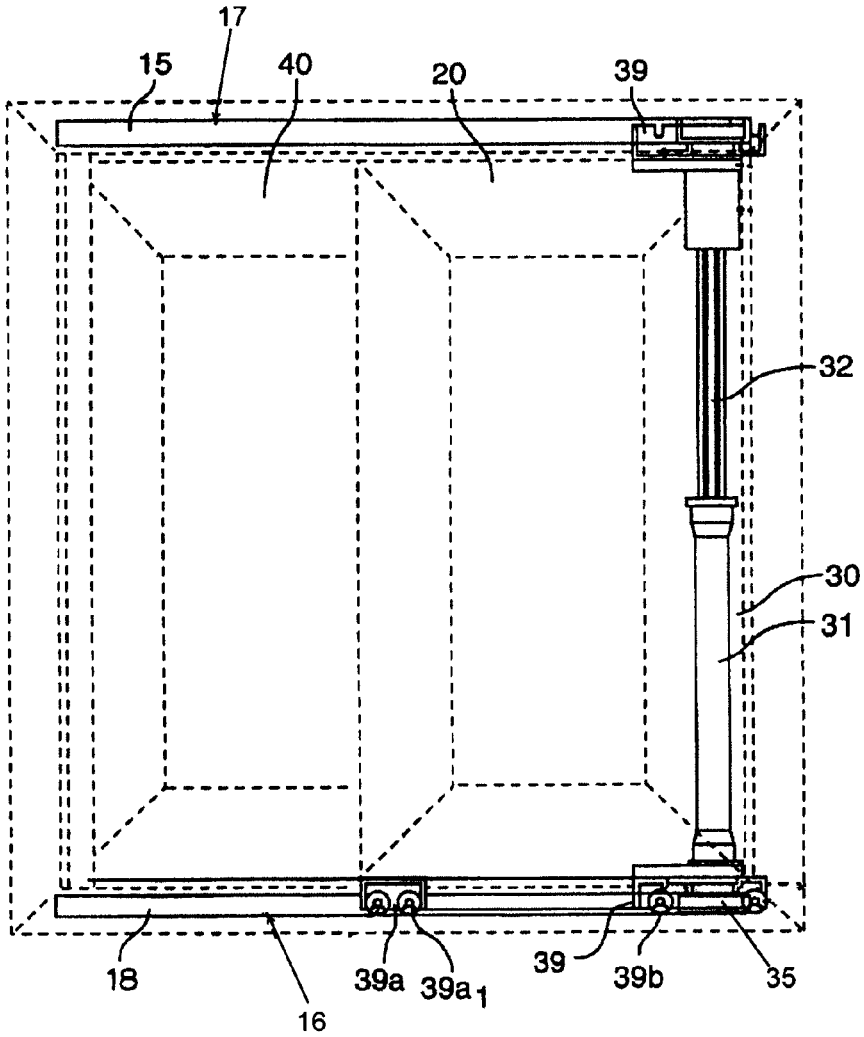
Figure 15 (PRIOR ART)
Figure 16:
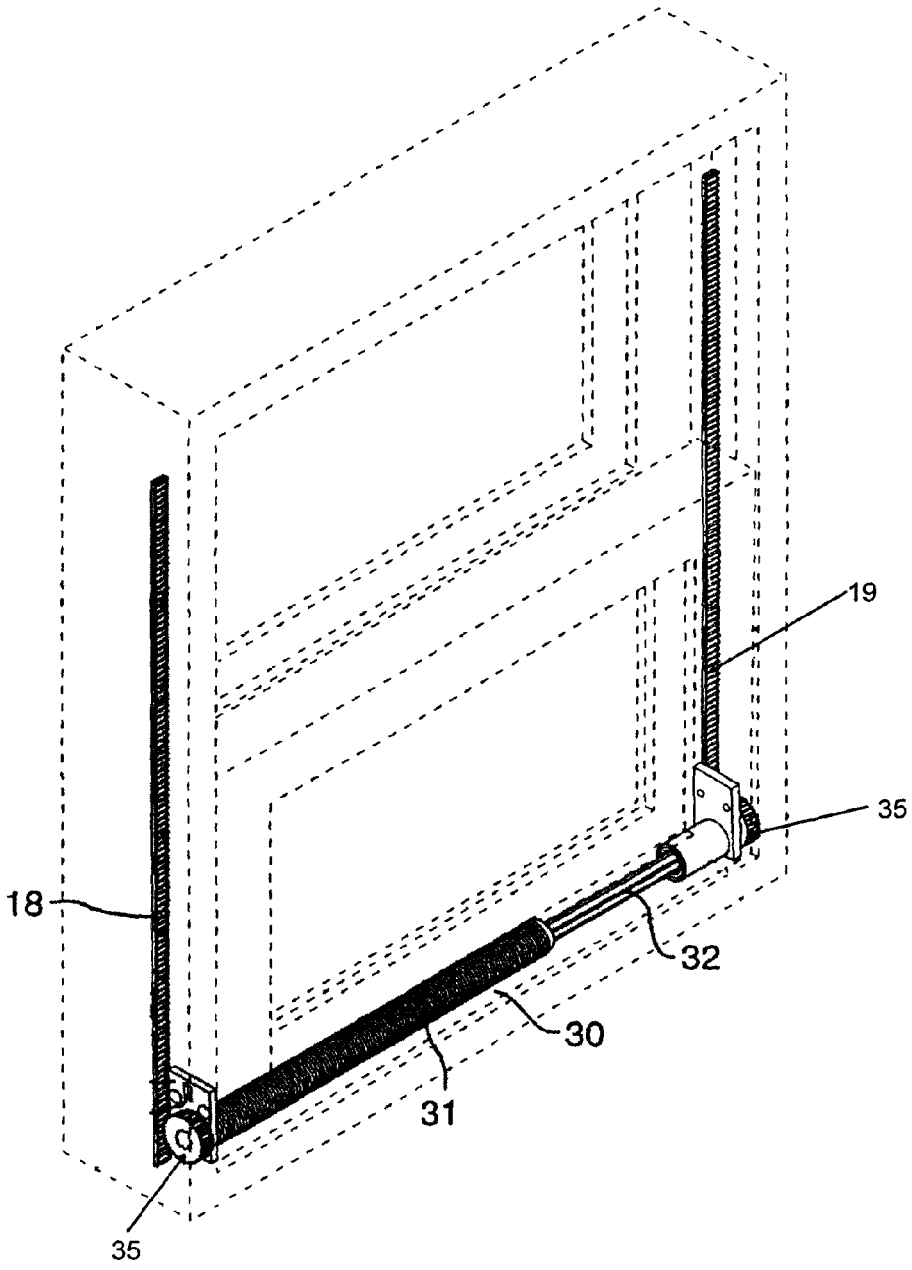
Figure 16 (PRIOR ART)

Referring to FIG. 4 and FIG. 12 the closure assembly is shown with the closure member 35*m* at an open position as seen from the interior of the building. The pivot assembly having a multiple segment shaft, first and second pivots, racks and pinions, is constructed according to the teachings of U.S. Pat. No. 5,687,506 as seen in FIGS. 14 through 16 the details of which are incorporated by reference in their entirety in relation to the teachings of the construction of the shaft (30), the pivot shoe (39), the rack 18 and cooperating pinion 35.

Figure 5:
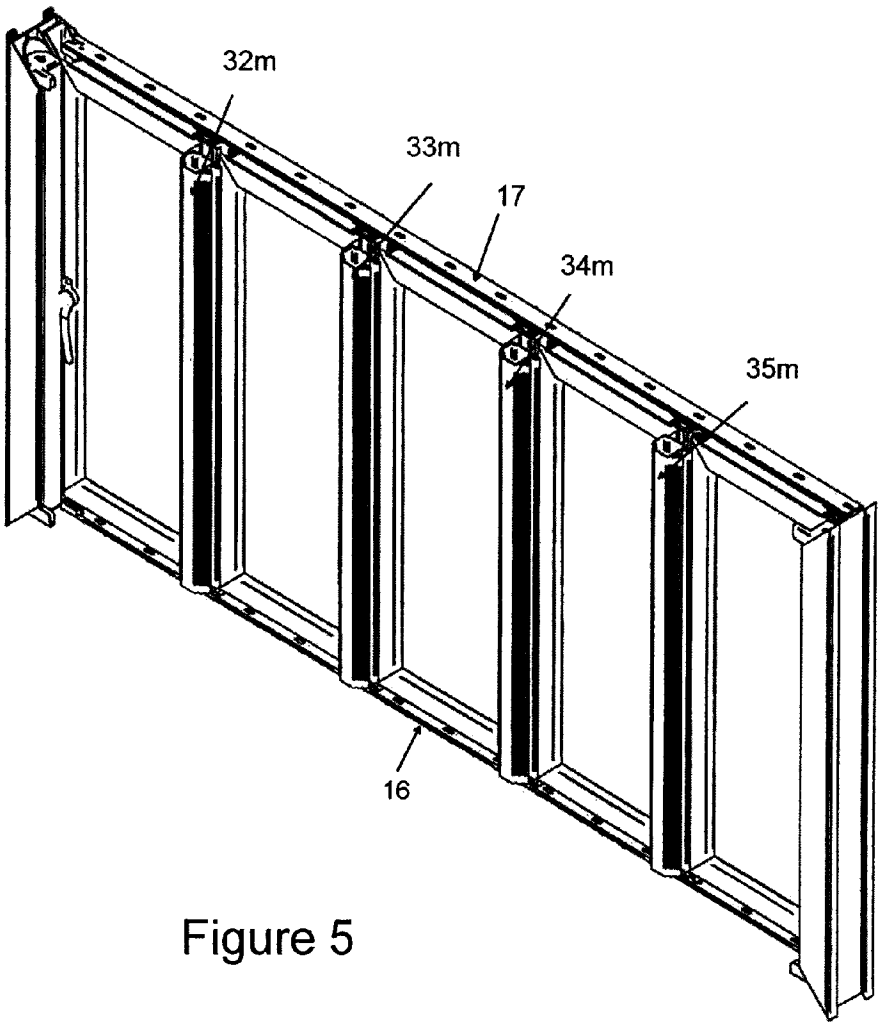
FIG. 5 is a perspective view of the components of the hardware of FIG. 3 to be installed in a multi closure member assembly.

Referring to FIG. 5 there is illustrated the closure assembly 11 from FIG. 1 with the framing members 10 and 20 removed, showing inter-engaging members 32*m*-35*m*, a track 17 in the header and a track 16 in the sill.

Figure 7:
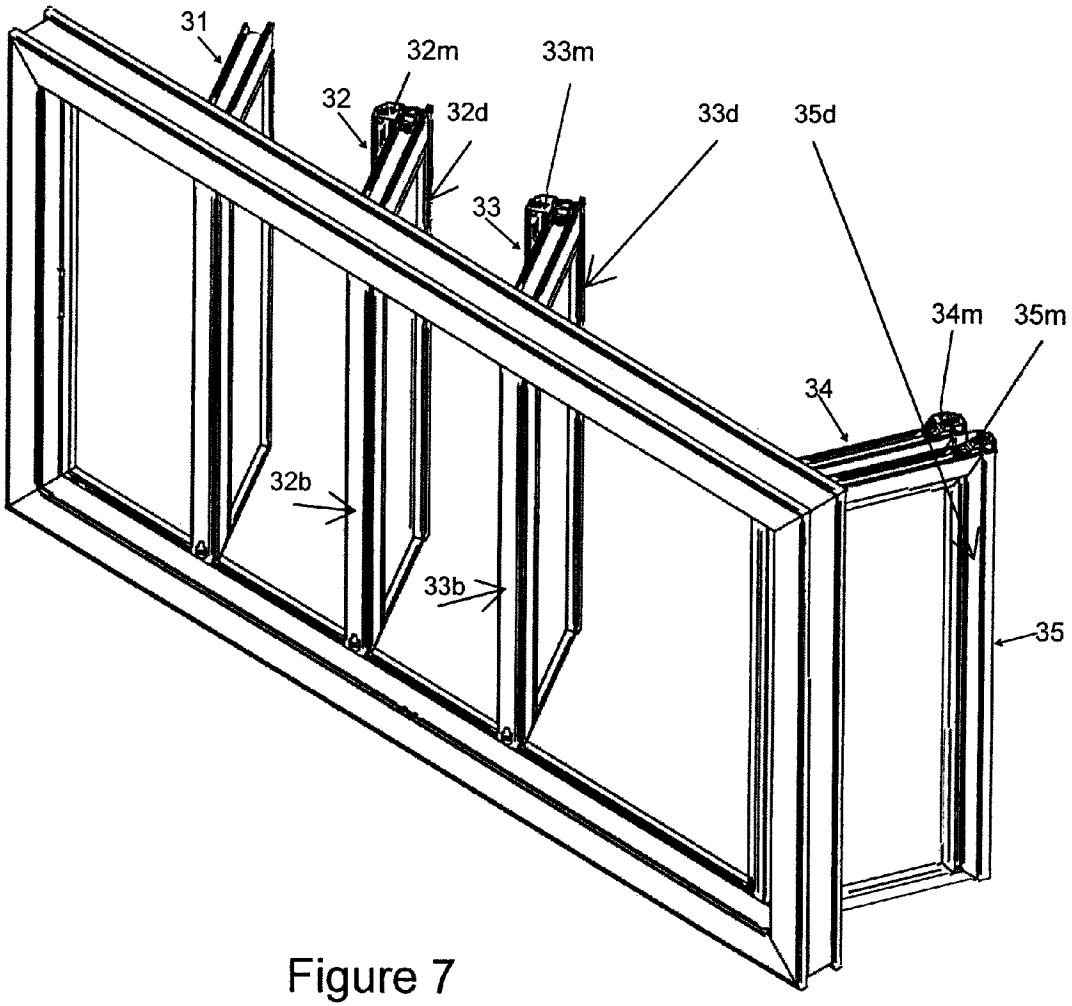
FIG. 7 is a further view of the closures of FIG. 6 with the members 34 and 35 both pivoted and moved laterally to a position whereat the free ends of said members inter-engage by inter-engaging members 34*m* and 35*m*.

Referring to FIG. 6 there is illustrated the closure assembly with all closures 31-35 shown in perspective pivoted away from said closure frame on their respective pivots. However each closure has yet to be moved in the track on its pivot shoe. In FIG. 7 closures 34 and 35 are shown with the pivot ends adjacent one another and the free ends thereof braced together by the inter-engagement of members 34*m* and 35*m* in FIG. 7, and as best seen and described in relation to FIG. 11.

Figure 8A:
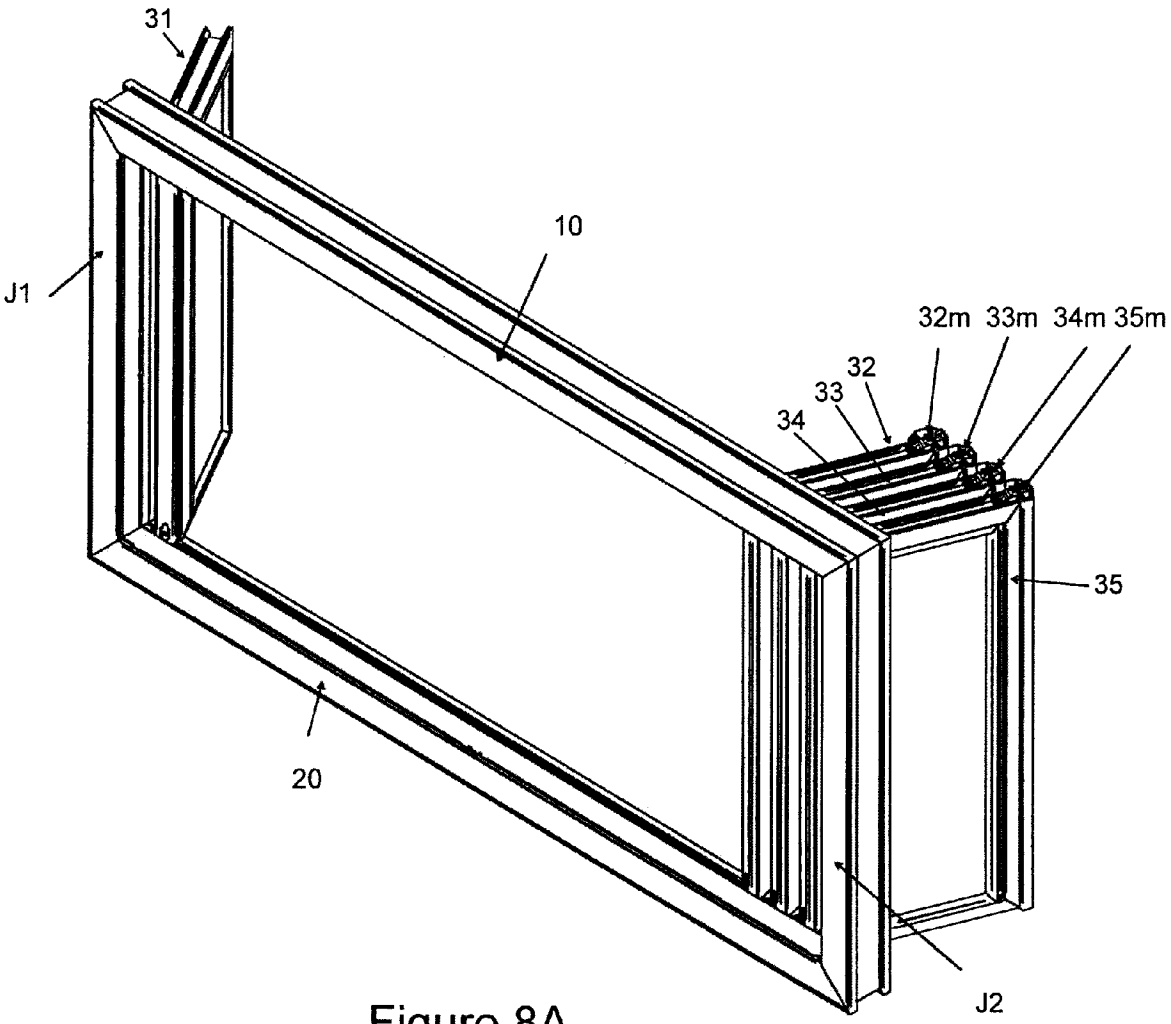
FIGS. 8A and 8B are yet further schematics and front views of the assembly of FIG. 7 illustrating the closure members at a position allowing for the maximum opening available for exiting the building and illustrated in a preferred embodiment of the invention.
Figure 8B:
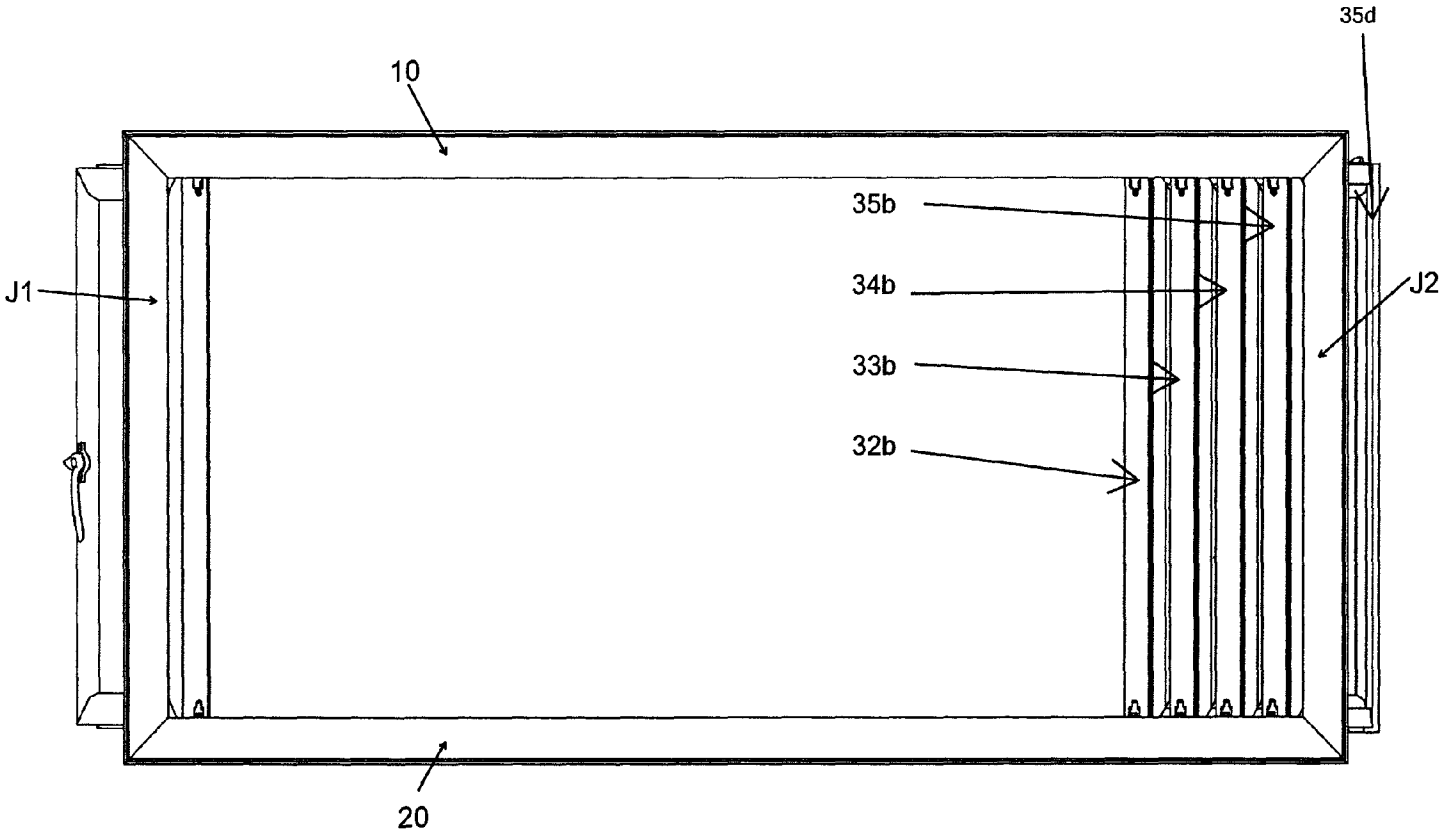

FIGS. 8A and 8B illustrate all closures 31 through 35 at the pivoted position providing the largest opening possible for entry or exit from the interior of the building. The screen assembly S1 may be used to cover that opening when not used to prevent insects from entering. Alternatively sunscreens or shades can be used which can be secured at the various positions shown herein, such as FIG. 5. The free ends of the closures (d) are braced to one another by bracing elements also referred to as inter-engaging members 32*m* through 35*m*, the details of which will be described hereinafter. In alternative embodiments other assemblies may include entry doors, French doors, patio doors, casement windows or the like as illustrated in FIG. 1. Very large "Window Walls" can be provided which in the example illustrated in FIG. 1 cover 15 foot openings which is heretofore unknown, and therefore open up many possibilities to interior design.

Figure 8C:
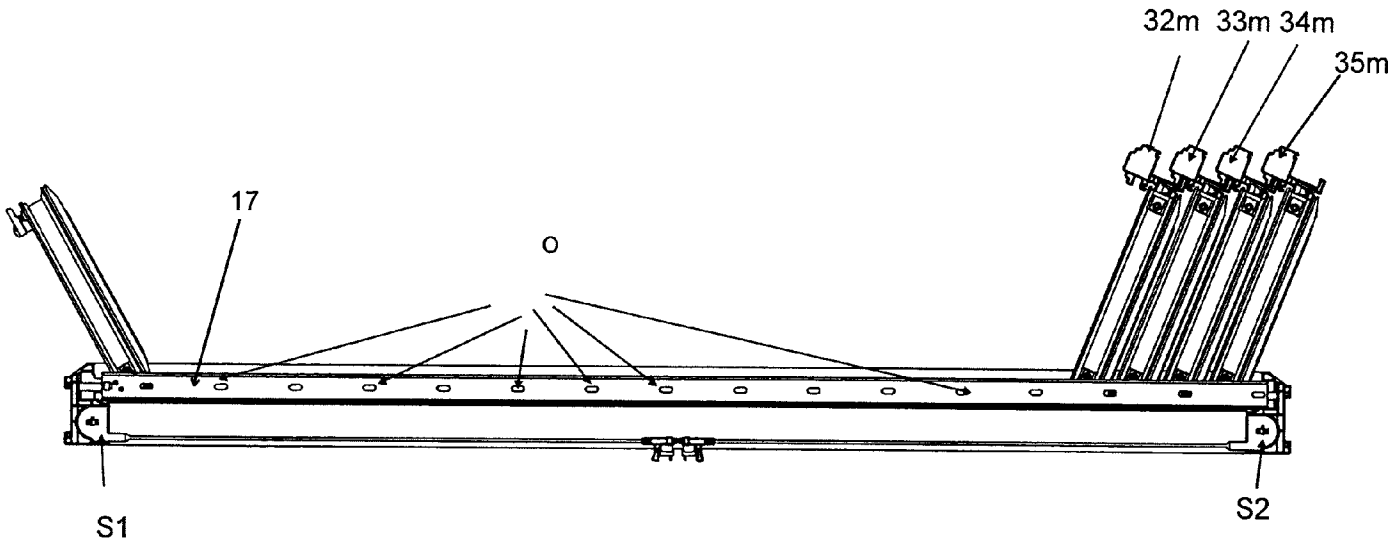
FIG. 8C is a top view of FIG. 8A.
Figure 9B:
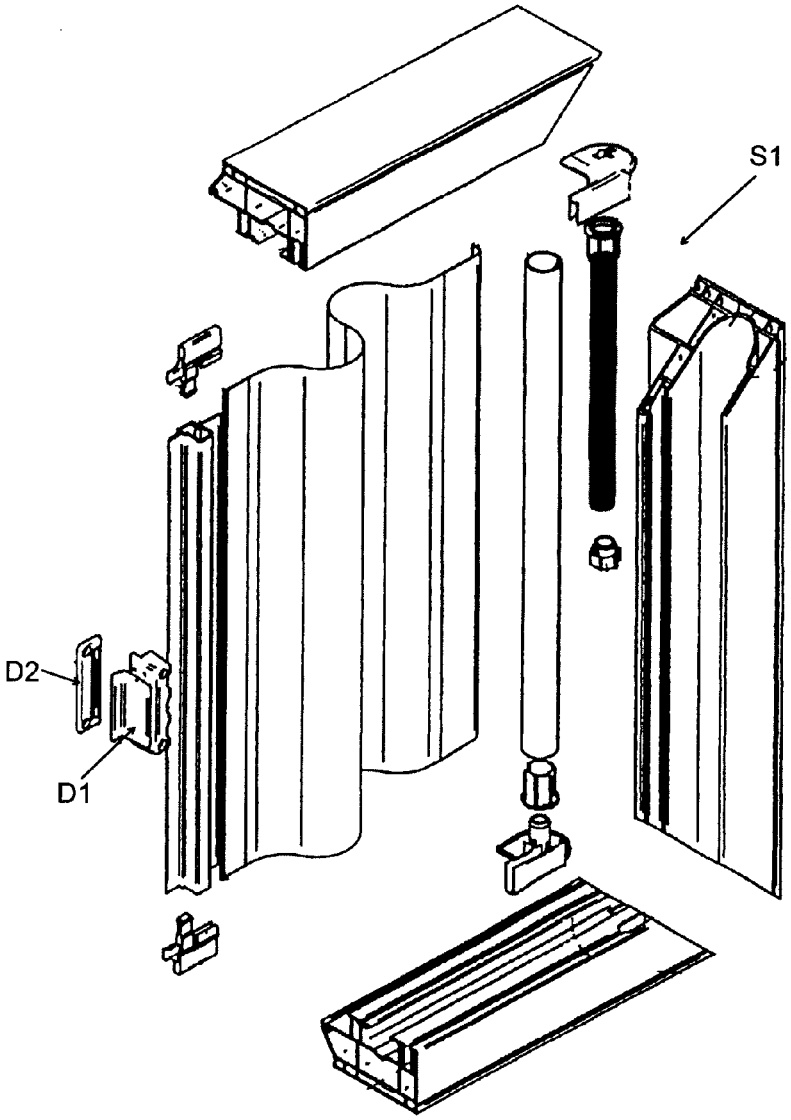
Figure 9B (PRIOR ART)
FIG. 9B is an exploded view illustrating a screen cassette of prior art.

As best seen in FIG. 8C and FIG. 5 a multiplicity of openings (o) are in track 17 and track 16 for drainage purposes. Further rollout screen assemblies S1 and S2 are shown hidden in the jamb pockets when not used but having handle assemblies butted together and secured as shown. FIG. 9A illustrates the pocket Pk from which the screen assembly pays/rolls/feeds out as taught in the aforementioned patent U.S. Pat. No. 6,405,781 the details of which are illustrated in FIG. 9B. The reader is referred to the description of FIG. 48 in that document the teachings of which are incorporated by reference herein in full.

Figure 10:
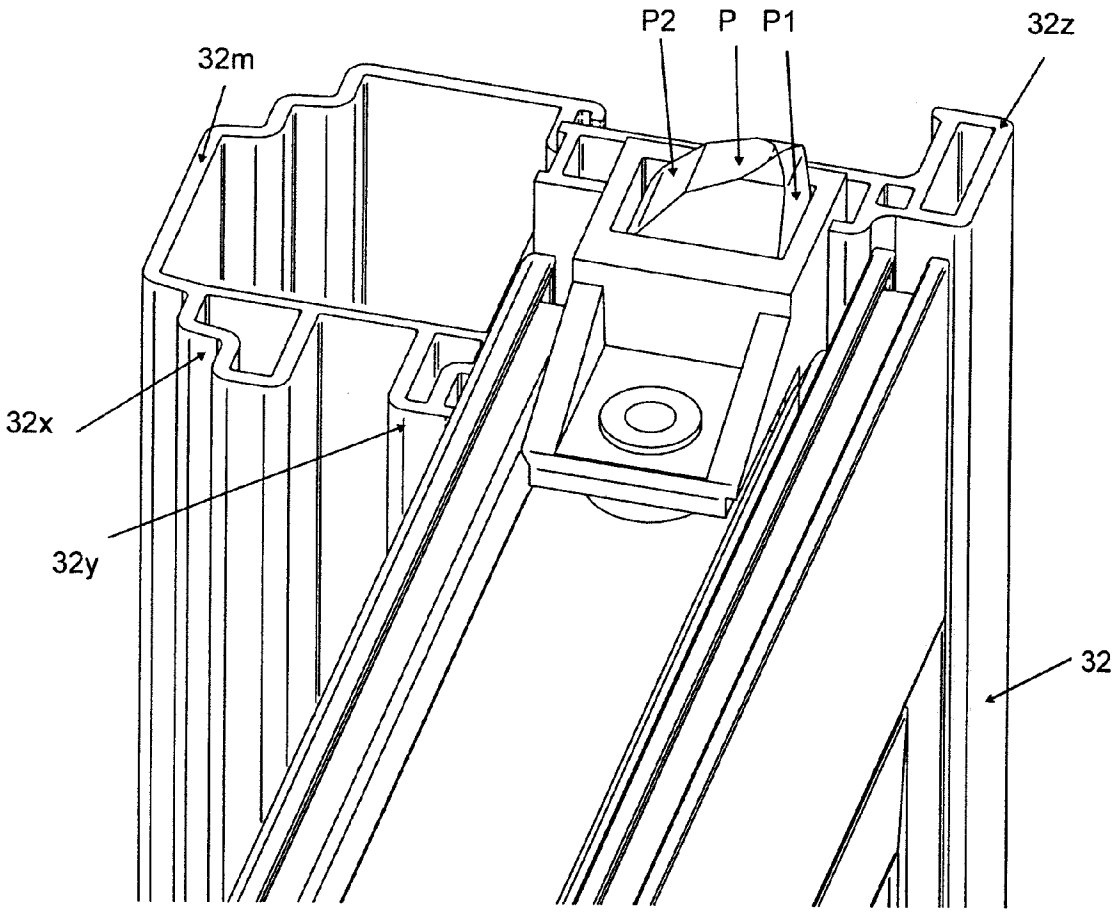
FIG. 10 is a close-up perspective illustration of the free end of closure member 32 with the inter-engaging member 32*m* installed at the free end of the closure member and illustrated in one embodiment of the invention.
Figure 11:
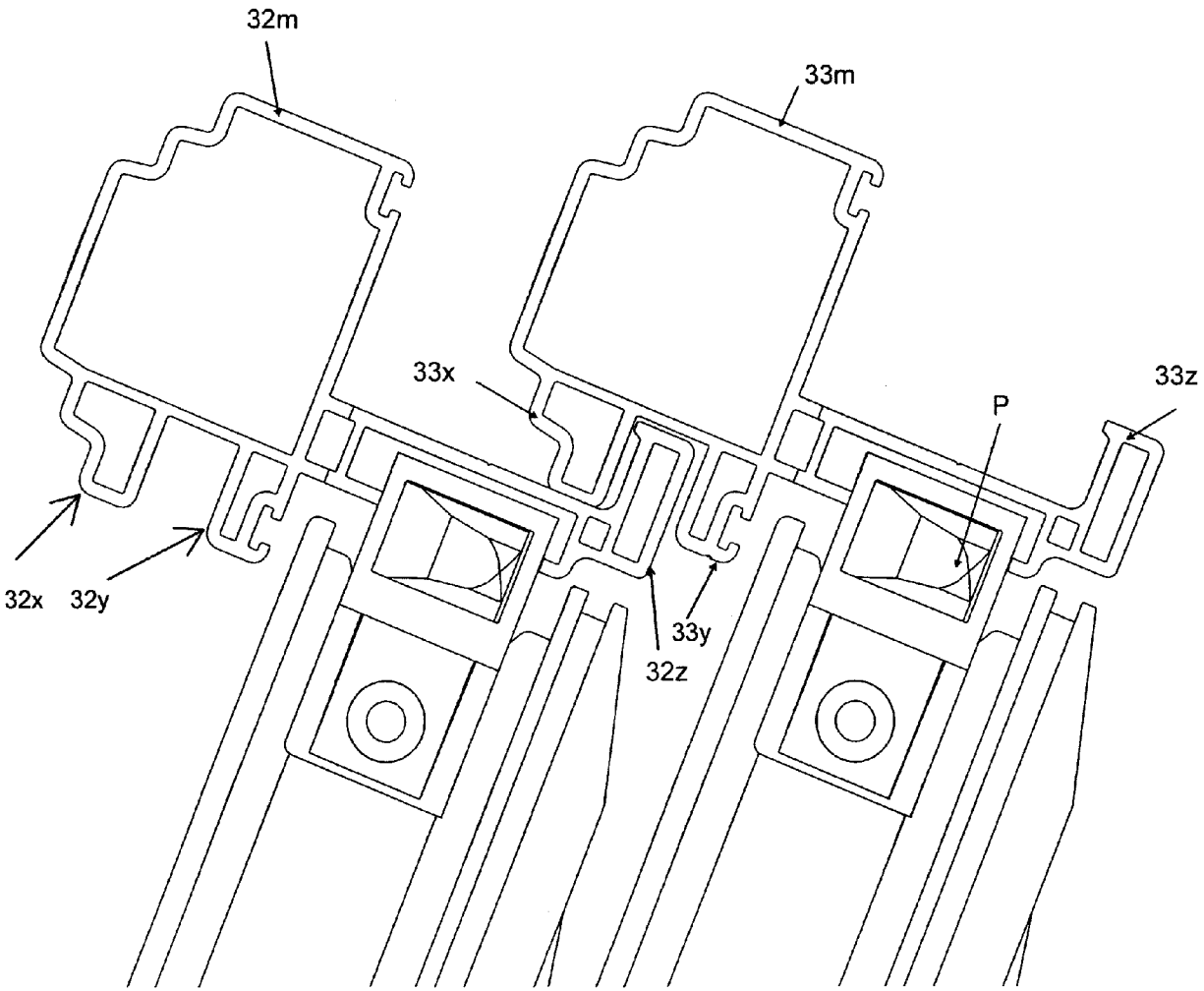
FIG. 11 is a close-up top view of the inter-engagement members shown in FIGS. 8A and 8C and illustrated in a preferred embodiment of the invention.

Referring to FIGS. 10, 11 and 12, the pin assembly P is spring biased to a channel in the frame and includes a shoulder P2 which releases from the channel when an opening motion of said closure is applied sufficient to overcome the force of the spring. This action permits the closure to move away from the closure frame in the opening direction at any position on the tracks.

When the closure is moved to the closed position the pin P engages the interior of the closure frame via blunt face P1 and is returned to its position in the channel.

In FIG. 10, the inter-engaging member 32*m* has two fingers 32*x* and 32*y*, and a foot 32*z*. In FIG. 11, the foot 32*z* is inter-engaged between fingers 33*x* and 33*y* of the inter-engaging member 33*m*. In FIG. 12, the inter-engaging members 32*m*-35*m* are interlocked in a similar manner.

Figure 13:
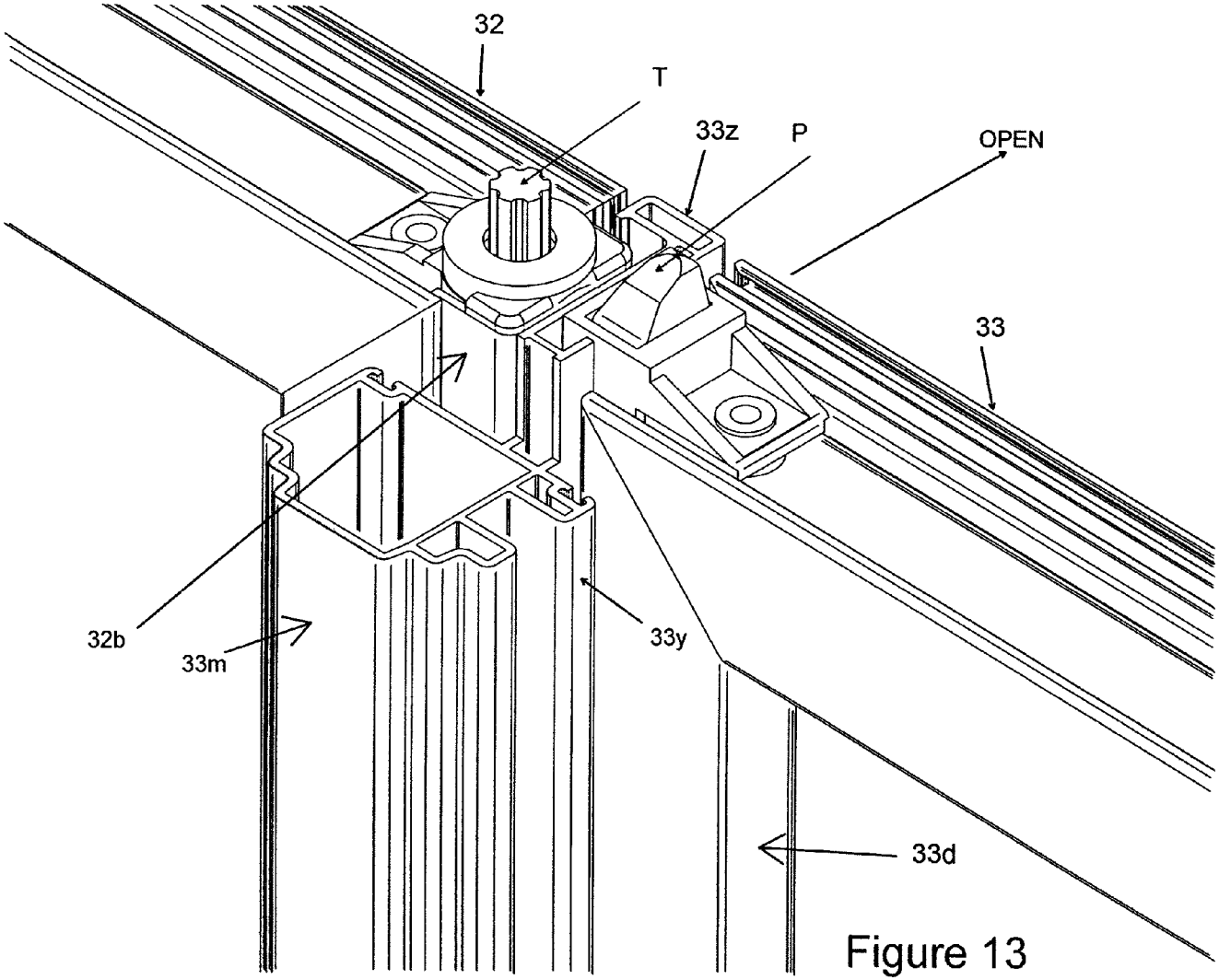
FIG. 13 is a perspective view of the closure assembly of FIG. 1 illustrating the operation of latching pin P and the engagement of a pivoting end with a free end of adjacent closures.

Referring to FIG. 13 there is illustrated the engagement of adjacent closure members at the free end (33*d*) and the pivoting end (32*b*) when at the closed position. The closure 33 on the right is free to pivot in an opening direction when sufficient force is applied by pushing on the closure in an opening direction to overcome the spring provided with the pin P. No handle is therefore necessary to do so. This is true for all closures 32 through 35 previously illustrated.

FIGS. 14 to 16 illustrate the pivot assembly of U.S. Pat. No. 5,687,506 used in the present closure assembly the teachings of which are incorporated by reference in their entirety herein. FIG. 14 illustrates a casement style window wherein only one sash is provided which is fastened on shaft assembly 30 including portions 31 and 32. A link L is provided secured proximate ends L1 adjacent the center of the sash 21 proximate the bottom thereof and adjacent the rack 18 adjacent the opening end of the window sash 21. By positioning the sash in this manner a full range of pivoting motion is available. If the link end L1 is removable from the sash, then the window sash may be moved totally to the opposite end remote the pivoting end 21*b* on shoe 39. Shoe 39 contains a pinion 39*a* which is connected to the shaft 30 and engages the rack 18 as it moves along the window sill and header in parallel arrangement between the upper and lower pivots maintained in parallel by the shaft 30. In this manner the casement style window may be pivoted as normal to an open position, and the pivoting end may be moved to the other end of the window frame away from side 21*b* to allow ease of cleaning. By supplying the hardware described herein, a casement window may be assembled without the need for expensive pivots and linkages and without a great deal of assembly labour. As seen in FIGS. 9A and 9B, a rollaway screen S1 may be provided which is housed in the jamb channel as illustrated. The screen S1 pulls across to engage detent D1 with detent D2 in the opposite channel jamb, whereat it may be locked. This allows a user to clean the glass on the inside without the need to remove the screen as in prior art casement structures.

FIG. 15 illustrates a two sash window in which sashes 20 and 40 are slidable within lower track 16 and upper track 17 upon upper and lower shoes 39. The lower shoe 39 may also be connected to a secondary shoe 39*a* as desired for carrying the window which includes rollers 39*b* on the bottoms thereof respectively for ease of movement within track 16. The pinions 35 rest within each shoe 39 which engage with the lower rack 18 and upper rack 15. Sash 40 has its own interconnected system which is not illustrated here.

Figure 17B:
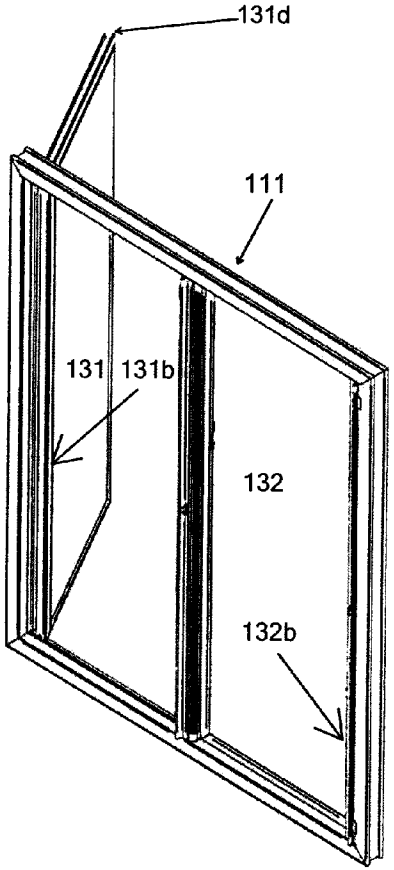
FIGS. 17A-C and 18A-C Illustrate one of the embodiments of the current invention in different operational states.
Figure 17A:
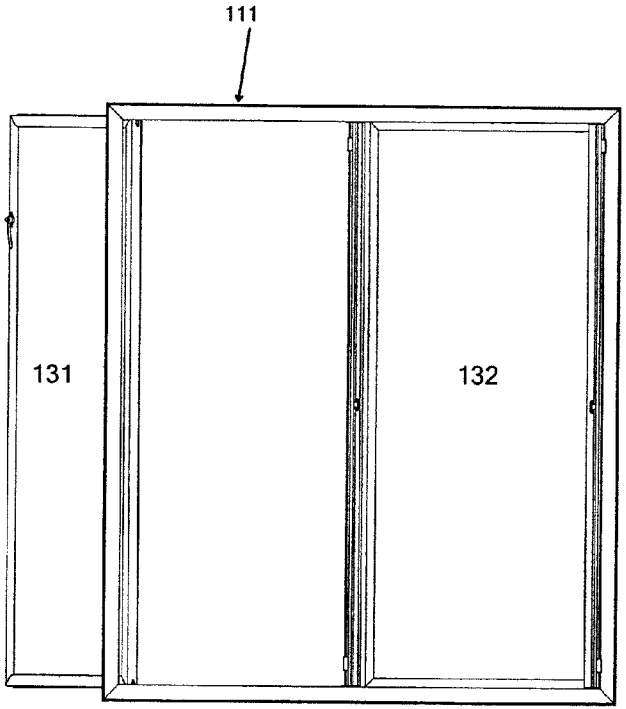
Figure 17C:
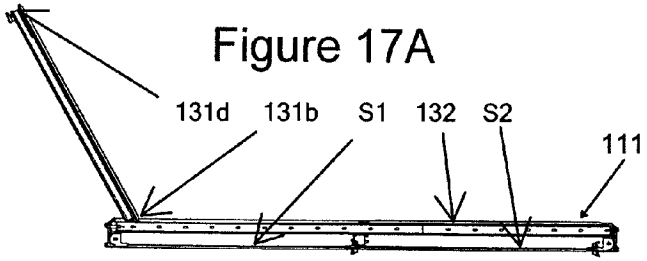
Figure 18B:
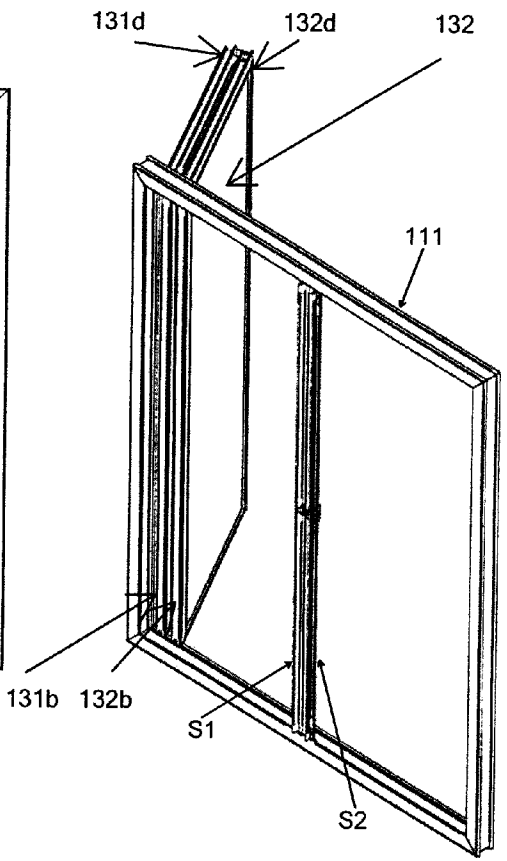
Figure 18A:
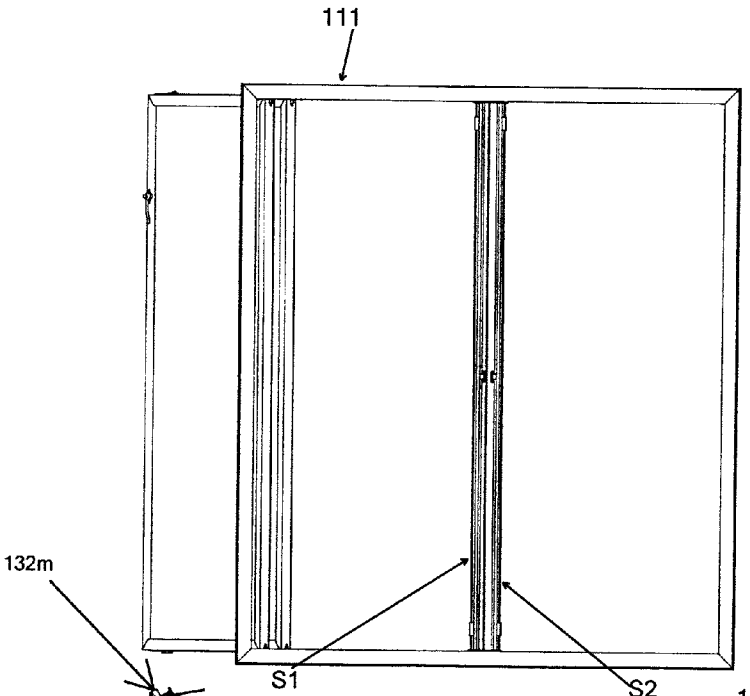
Figure 18C:
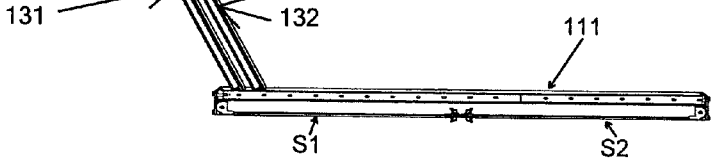

FIG. 17A illustrates a two pane closure 111 with the left closure 131 open and right closure 132 shut as best seen in FIGS. 17B and 17C. In this illustration the two bug screens S1 and S2 are in a closed position abutting proximate the center of the opening. FIGS. 18A-C illustrates the same embodiment of the closure with two panes 131 and 132 while the right pane 132 is moved to the left of the closure as best illustrated in FIGS. 18B and 18C. In this position the pivoting ends 131*b* and 132*b* are close together and free ends 131*d* and 132*d* are inter-engaged by the inter-engaging member 132*m*. The bug screens S1 and S2 in this embodiment are also closed.

As many changes can be made to the preferred embodiments of the invention without departing from the scope thereof. It is intended that all matter contained herein be considered illustrative of the invention and not it a limiting sense.

The invention claimed is:

1. A closure assembly for a window framing section, the window framing section having first and second jambs along opposing sides of the window framing section, a header along a top of the window framing section between the first and second jambs, and a sill along the bottom of the window framing section between the first and second jambs, the closure assembly comprising:

a first track disposed substantially along an entire length of the header and extending substantially from the first jamb to the second jamb of the window framing section, a second track disposed along an entire length of the sill and extending substantially from the first jamb to the second jamb of the window framing section, at least first and second closure members secured in the window framing section for lateral and rotational movement within the window framing section, the first and second closure members each including a respective frame having a free end and a pivot end, the free ends pivoting into the window framing section in a window closed configuration, and pivoting away from the window framing section in a window open configuration, the pivot ends of the first and second closure members each having first and second pivots adjacent the first track and second track respectively, the first and second pivots of each closure member being interconnected by a shaft disposed within the closure member and the shaft pivotally supporting the closure member for swinging between the window open configuration and the window closed configuration, the first closure member having a first inter-engaging member proximate the free end of the first closure member, the first inter-engaging member having a first inter-engaging portion and a second inter-engaging portion, the second closure member having a second inter-engaging member proximate the free end of the second closure member, the second inter-engaging member having a third inter-engaging portion, wherein the first inter-engaging portion of the first closure member releasably interlocks with the third inter-engaging portion of the second closure when the first and second closure members are in the open configuration and the free end of the first closure member is adjacent the free end of the second closure member, and the second inter-engaging portion of the first closure member releasably interlocks with the pivot end of the second closure member, when the first and second closure members are in the closed configuration and the free end of the first closure member is adjacent the pivot end of the second closure member.

2. The closure assembly of claim 1 wherein the first closure member and the second closure member each are movable along the first and second tracks at each of their pivot ends.

3. The closure assembly of claim 2, wherein the first track has a first rack that runs along the entire length of the first track, the second track has a second rack that runs along the entire length of the second track, the first pivot end of each of the first and second closure members respectively has a first pinion that engages the first rack, and the second pivot end of each of the first and second closure members respectively has a second pinion that engages the second rack, the respective racks and pinions providing for alignment of the first and second pivot ends within the first and second tracks in a substantially perpendicular line with respect to the first and second tracks.

4. The closure assembly of claim 1 wherein the first inter-engaging portion of the first closure member releasably interlocks with the open end of the second closure member when the first and second closure members are in the open configuration, the free end of the first closure member is adjacent the free end of the second closure member, the pivot end of the first closure member is adjacent the pivot end of the second closure member, and the pivot end of the first closure member is in close proximity to the first jamb.

5. The closure assembly of claim 1 further comprising:

a third closure member including a frame having a free end and a pivot end, the free end of the third member pivoting into the window framing section in the window closed configuration, and pivoting away from the window framing section in the window open configuration, the pivot end of the third closure member having first and second pivots adjacent the first track and second track respectively, the first and second pivots of the third closure member being interconnected by a shaft disposed within the third closure member and the shaft pivotally supporting the third closure member for swinging between the window open configuration and the window closed configuration, the second inter-engaging member proximate the free end of the second closure member having a fourth inter-engaging portion, the third closure member having a third inter-engaging member proximate the free end of the third closure member, the third inter-engaging member having a fifth inter-engaging portion, wherein the fourth inter-engaging portion of the second closure member releasably interlocks with the fifth inter-engaging member of the third closure member when the second and third closure members are in the open configuration and the free end of the second closure member is adjacent the free end of the third closure member, and the third inter-engaging portion of the second closure member releasably interlocks with the pivoting end of the third closure member when the second closure member and third closure member are in the closed configuration and the pivot end of the second closure member is adjacent the free end of the third closure member.

6. The closure assembly of claim 5 further comprising a handle attached to the third closure member, for swinging the third closure member between the open and closed positions of the third closure member.

7. The closure assembly of claim 5 further comprising a locking mechanism for releasable locking the first, second and third closure members in place when the first, second and third closure members are in the closed position.

8. The closure assembly of claim 1 wherein the first inter-engaging portion of the first closure member includes two fingers defining a channel, and the third inter-engaging portion of the second closure member comprises a foot that fits into the channel when the first and second closure members are in the open configuration and the free end of the first closure member is adjacent the free end of the second closure member and so that the first inter-engaging portion of the first closure member releasably interlocks with the third inter-engaging portion of the second closure member.

9. The closure assembly of claim 1 wherein the second inter-engaging portion of the first closure member includes a foot that forms a pocket to engage the pivot end of the second closure member when the first and second closure members are in the closed configuration and the pivot end of the first closure member is adjacent the free end of the second closure member so that the second inter-engaging portion of the first closure member releasably interlocks with the second closure member.

10. The closure assembly of claim 1, wherein the first and second closure members provide a seal between one another in the closed configuration when the pivot ends of the first and second closure members are adjacent to each other and present a straight inline flush appearance for the first and second closure members in relation to the closure assembly.

11. The closure assembly of claim 1, wherein at least the first closure member includes a pin assembly that is biased by a spring to a channel in the first track, the pin assembly including a shoulder which releases from the first track when an opening motion of the first closure member is applied sufficient to overcome a force of the spring.

12. The closure assembly of claim 1 further comprising a retractable screen attached to one of the first and second jambs and a releasable locking mechanism attached to the other one of the first and second jambs, the retractable screen can be stretched across the closure assembly and releasably locked to the releasable locking mechanism.

13. A closure assembly for a window framing section, the window framing section having first and second jambs along opposing sides of the window framing section, a header along a top of the window framing section between the first and second jambs, and a sill along a bottom of the window framing section between the first and second jambs, the closure assembly comprising:

a first track disposed substantially along an entire length of the header and extending substantially from the first jamb to the second jamb of the window framing section, a second track disposed along an entire length of the sill and extending substantially from the first jamb to the second jamb of the window framing section, a first, second and third closure members secured in the window framing section for lateral and rotational movement within the window framing section, the first, second and third closure members each including a respective frame having a free end and a pivot end, the free ends pivoting into the window framing section in a window closed configuration, and pivoting away from the window framing section in a window open configuration, the pivot ends of the first, second and third closure members each having first and second pivots adjacent the first track and second track respectively, the first and second pivots of each closure member being interconnected by a shaft disposed within the closure member and the shaft pivotally supporting the closure member for swinging between the window open configuration and the window closed configuration, the first, second and third closure members each being movable along the first and second tracks at each of their pivot ends, wherein the first track has a first rack that runs along the entire length of the first track, the second track has a second rack that runs along the entire length of the second track, the first pivot of each of the first and second closure members respectively has a first pinion that engages the first rack, and the second pivot of each of the first and second closure members respectively has a second pinion that engage the second rack, the respective racks and pinions providing for alignment of the first and second pivots within the first and second tracks in a substantially perpendicular line with respect to the first and second tracks, the first closure member having a first inter-engaging member proximate the free end of the first closure member, the first inter-engaging member having a first inter-engaging portion and a second inter-engaging portion, the second closure member having a second inter-engaging member proximate the free end of the second closure member, the second inter-engaging member having a third and fourth inter-engaging portion, the third closure member having a third inter-engaging member proximate the free end of the third closure member, the third inter-engaging member having a fifth inter-engaging portion, the first inter-engaging portion of the first closure member releasably interlocks with the third inter-engaging portion of the second closure member when the first and second closure members are in the open configuration and the free end of the first closure member is adjacent the free end of the second closure member, and the second inter-engaging portion of the first closure member releasably interlocks with the pivot end of the second closure member when the first and second closure members are in the closed configuration and the free end of the first closure member is adjacent the pivot end of the second closure member, the fourth inter-engaging portion of the second closure member releasably interlocks with the fifth inter-engaging portion of the third closure member when the second and third closure members are in the open configuration and the free end of the second closure member is adjacent the free end of the third closure member, the third inter-engaging portion of the second closure member releasably interlocks with the pivot end of the third closure member when the second and third closure members are in the closed configuration and the free end of the second closure member is adjacent the pivot end of the third closure member.

14. The closure assembly of claim 13, wherein the first inter-engaging portion of the first closure member releasably interlocks with the free end of the second closure member when the first and second closure members are in the open configuration, the free end of the first closure member is adjacent the free end of the second closure member, the pivot end of the first closure member is adjacent the pivot end of the second closure member, and the pivot end of the first closure member is in close proximity to the first jamb.

15. The closure assembly of claim 13, wherein at least the first and second closure members each includes a pin assembly that is biased by a spring to a channel in the first track, the pin assembly including a shoulder which releases from the first track when an opening motion of the first closure member is applied sufficient to overcome a force of the spring.

16. The closure assembly of claim 13, wherein the first, second and third closure members provide a seal between one another in the closed configuration when the pivot ends of the first, second, and third closure members are adjacent to each other and present a straight inline flush appearance for the first, second and third closure members in relation to the closure assembly.

17. The closure assembly of claim 13 wherein the first inter-engaging portion of the first closure member includes two fingers defining a channel, and the third inter-engaging member of the second closure member comprises a foot that fits into the channel when the first and second closure members are in the open configuration and the free end of the first closure member is adjacent the free end of the second closure member and so that the first inter-engaging portion of the first closure member releasably interlocks with the third inter-engaging portion of the second closure member.

18. The closure assembly of claim 13 wherein the third inter-engaging portion of the second closure member includes a foot that forms a pocket to engage the pivot end of the third closure member when second and third closure members are in the closed configuration and the pivot end of the third closure member is adjacent the free end of the second closure member and so that the third inter-engaging portion of the second closure member releasably interlocks with the third closure member.

* * * * *